United States Patent [19]

McClenahan

[11] Patent Number: 5,062,486

[45] Date of Patent: Nov. 5, 1991

[54] FIREFIGHTER'S BARRIER PENETRATOR AND AGENT INJECTOR

[76] Inventor: Charles H. McClenahan, 98 Hurlburt Rd., Fort Walton Beach, Fla. 32548

[21] Appl. No.: 447,497

[22] Filed: Dec. 7, 1989

[51] Int. Cl.[5] ..... A62C 13/62

[52] U.S. Cl. ..... 169/70; 239/271; 173/91; 222/80

[58] Field of Search ..... 169/20; 239/271; 173/90, 91; 222/5, 80, 85, 87; 141/329; 227/27

[56] References Cited

U.S. PATENT DOCUMENTS

| | | | |
|---|---|---|---|
| 4,147,216 | 4/1979 | Schnepfe, Jr. | 239/271 |
| 4,241,795 | 12/1980 | Landry, Jr. | 173/90 |
| 4,609,052 | 9/1986 | Lewin | 173/91 |
| 4,676,319 | 6/1987 | Cuthbertson | 169/70 |
| 4,832,265 | 5/1989 | Anfosso et al. | 169/70 |
| 4,922,848 | 5/1990 | Thiel | 239/271 |

*Primary Examiner*—Joseph F. Peters, Jr.
*Assistant Examiner*—Christopher P. Ellis
*Attorney, Agent, or Firm*—Donald D. Mon

[57] ABSTRACT

A firefighter's barrier penetrator and agent injector having an extendible slide rod to guide a slide hammer to strike a penetrating body to drive its point through the barrier. The slide rod can be retracted into the body to minimize the length of the penetrator while being carried. A nozzle is slidably mounted in the body to be extendible into the structure for injection purposes, again to minimize the carrying length. Retention devices releasably hold the rod and nozzle in their retracted positions.

7 Claims, 2 Drawing Sheets

FIREFIGHTER'S BARRIER PENETRATOR AND AGENT INJECTOR

FIELD OF THE INVENTION

This invention relates to tools for extinguishing fires, and in particular to a penetrator for penetrating a barrier and injecting fire extinguishing agents or suppressant agents into a critical area.

BACKGROUND OF THE INVENTION

To suppress fires in enclosed structures such as residential attics or aircraft fuselages, as examples, the firefighter has the need to penetrate the structure with a nozzle through which he can inject fire extinguishing agents such as water or foam, or fire suppressant agents such as carbon dioxide, Halon, and AFFF. Fire extiguishing agents, and fire suppressant agents will for convenience be described herein merely as "agents". They will always be fluid—either a gas or a liquid, or a combination such as foam. There are, of course, time-honored procedures for doing this, some as simple as cutting a hole with an axe and shoving the nozzle through the opening.

This simplistic approach illuminates the many problems that are involved. One of the major problems is that the equipment is used under the most trying circumstances. By his very proximity to the fire, the firefighter is exposed to considerable danger. To reach the point of application of the tool he will already have gone through much exertion and anxiety. When he arrives at that point, to reduce his stress the tool should have had the least possible weight and have required the least possible physical exertion and care to get it there. Furthermore, the exertion that will be required to apply the tool to its task should not require the firefighter to assume risky or unbalanced postures.

While an axe might be a tool of most minimum weight, when the firefighter arrives he will have to take a hopefully balanced stance and make a number of strokes whose end result cannot accurately be guessed. If the axe goes on through the structure, for example, it could throw him off balance, and perhaps he will even lose the tool. Even if this is safely done, and it often is, there are two more concerns. The first concern is that if a hole of excessive size is cut, too much air can enter, and it can cause an explosive increase in the intensity of the fire and of its smoke. Such flare-ups, particularly in aircraft, have caused death and serious injury. The smaller the aperture for injection of suppressant agent, the better, and this is not best accomplished by swinging an axe at the structure.

Also, once the hole is cut, it is necessary to get a nozzle into it so the agent can be injected into the structure. If the firefighter wields an axe, and also is expected to insert the nozzle, he must discard the axe, grab the nozzle and insert it. This takes effort, and even if the nozzle is carried by another firefighter, it will take extra time. Extra time includes not only extra risk to the firefighter but additional property damage, and additional risk to occupants of the structure such as passengers in an aircraft fuselage.

Tools have been proposed and do exist which include rotary drill motors and bits to penetrate into structures, and which include nozzle means for injection of agents after penetration. One problem with such devices is their size, weight and bulkiness. Not only is the rig heavy because of the necessary drive mechanism for the drill, but power means such as bottled gas must be carried along to power it, or a power supplying hose must be brought along for power. Both of these expedients tire the firefighter.

It is an object of this invention to provide an elegantly simple penetrator which in its condition to be carried to its point of application has a minimum bulk and weight. Further, it carries as part of itself a slide hammer to exert penetrating blows on the structure through the tool body. The slide hammer slides on an integral guide rod which extends from the body of the tool only when blows are to be exerted. The tool thus can be retracted into a minimum bulk for carrying to its point of application. It can also be stored in a minimum space envelope.

When the blows are to be exerted, the hammer is constrained to an axial path, and requires no care by the firefighter. He simply cycles the hammer along the guide rod until the blows delivered by the tool causes the tool to penetrate the structure. Then an agent is injected into the penetrated structure through the tool. This is a simple, lightweight, reduced maintenance and trouble-free tool.

BRIEF DESCRIPTION OF THE INVENTION

A penetrator according to this invention includes an impact barrel having a central axis, an internal axially extending guide wall, a striker end, and an impact end. An axially extending nozzle barrel makes a sliding, fluid-sealing fit in the guide wall. A point is attached to one end of the nozzle barrel. The impact end is closed by its own structure, or by the point. The point has a laterally extending shoulder laterally aligned with the impact end of the impact barrel. A first socket is formed at the impact end, and a second socket at the striker end disposed on said central axis. The nozzle barrel has a plurality of nozzle ports through its wall.

A nozzle passage extends axially in the nozzle barrel. A slide rod is slidably fitted in the nozzle passage extending along the axis. A retainer member is attached to the rod inside the nozzle barrel with two oppositely facing tapers adapted to fit into respective sockets so as to remain in a selected position until overcome by a sufficient axial force. A slide hammer is fitted to the slide rod outside of the impact barrel. It is adapted to slide bi-directionally along the slide rod, and to impact the striker end of the impact barrel. A port is formed in the impact barrel to admit agents, whereby with the retainer in the first socket the slide rod is retained in the impact barrel, and when the retainer is pulled in the opposite direction and the retainer is held in the second socket, the slide rod extends away from the impact barrel to provide guidance for the slide hammer. When the point has pierced a structure, fluid under pressure in the nozzle barrel will shift the nozzle barrel to expose the nozzle ports and enable agents to be injected into the structure.

According to a preferred but optional feature of the invention the sockets and retainer are tapered so as to be retained to one another as the consequence of being pressed together.

According to yet another preferred but optional feature of the invention, the slide hammer includes a brake which holds it against sliding movement along the slide rod until and unless it is released.

The above and other features of this invention will be fully understood from the following detailed description and the accompanying drawings, in which:

DETAILED DESCRIPTION OF THE INVENTION

Figure 1:
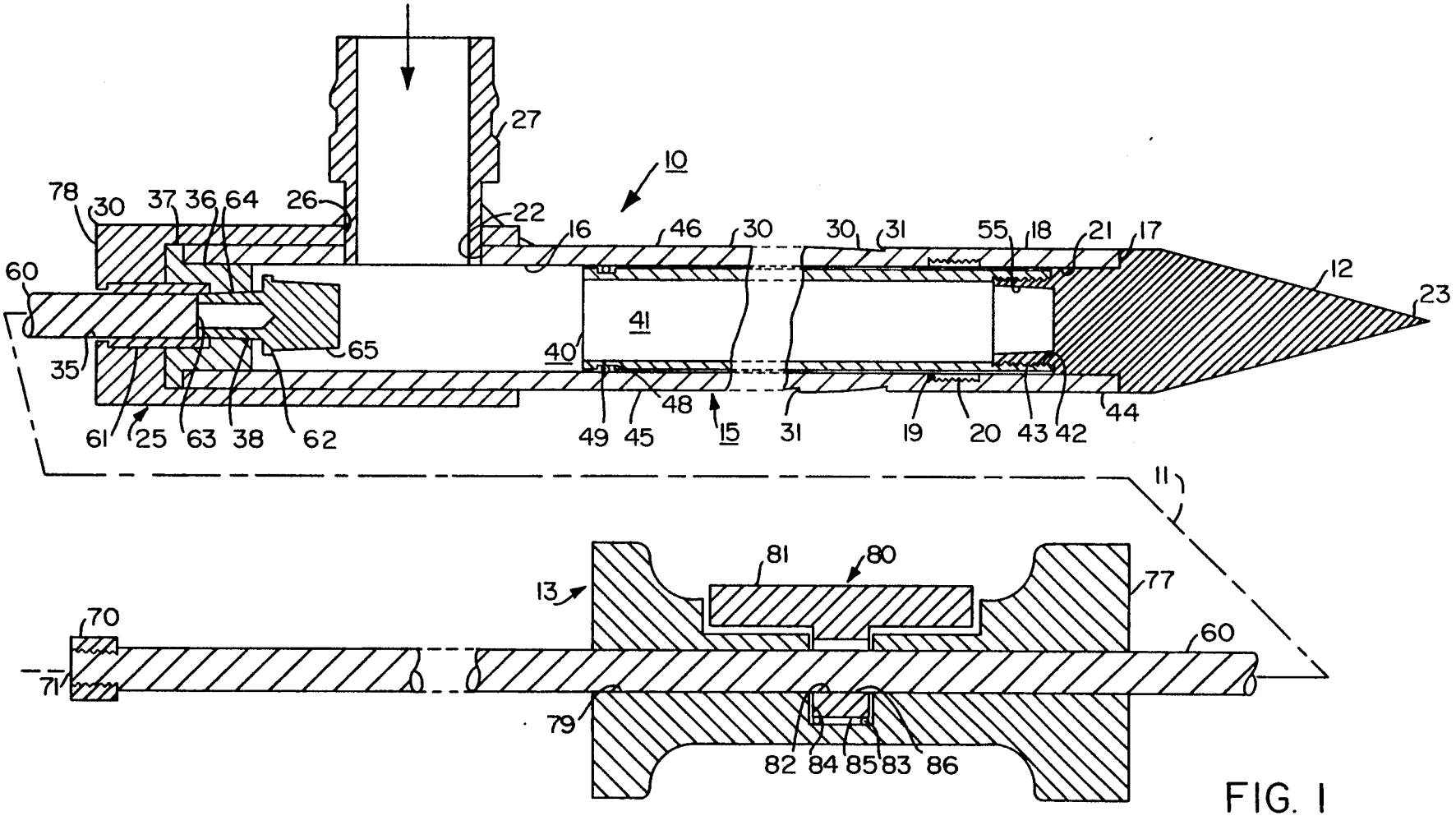
FIG. 1 is an axial cross-section of the presently preferred embodiment of the invention.
Figure 2:
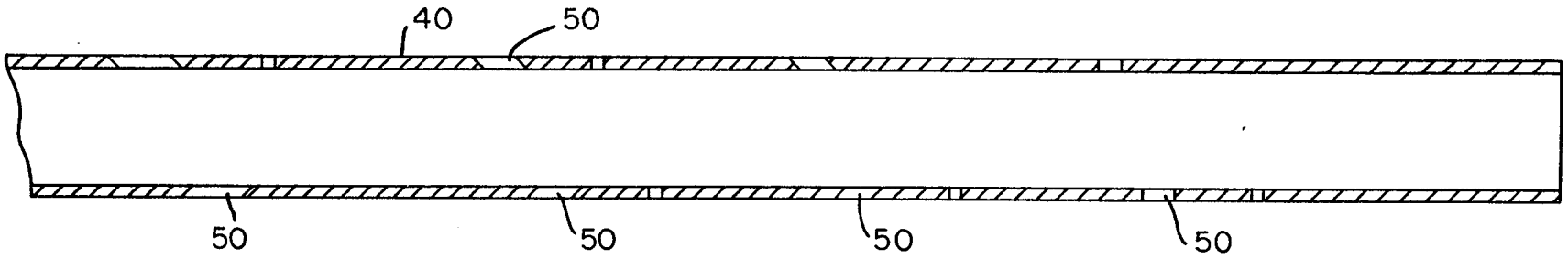
FIG. 2 is an axial cross-section of a portion of the nozzle barrel.
Figure 3:
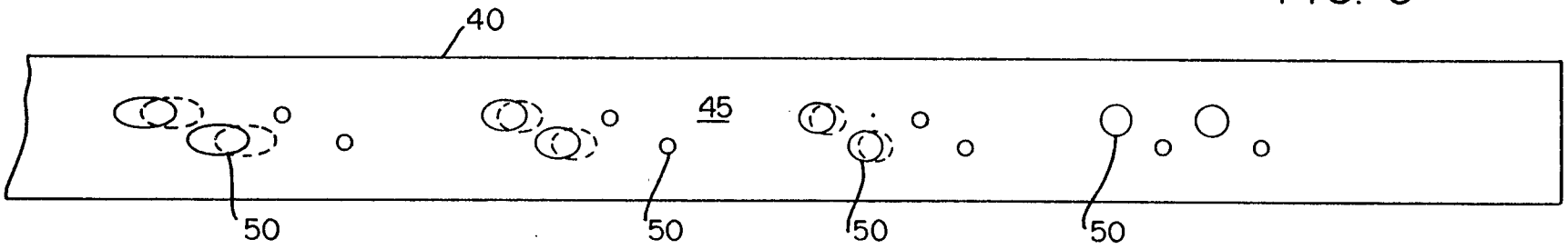
FIG. 3 is a side view of a portion of the nozzle barrel.

A tool 10 according to this invention is shown in FIG. 1. Because of its length, it is best shown in offset sections. The continuity of its central axis 11 will be recognized. The objective is to pierce a structure (not shown) with a sharp-ended point 12 as the consequence of blows exerted with a slide hammer 13, and then to inject agents into the structure.

The tool includes an outer impact barrel 15. Barrel 15 is tubular. It has an internal guide passage 16 extending along the central axis. Over most of its length it has a cylindrical shape with a uniform diameter. However, its impact end 17 is formed by an adapter 18 which has an internal thread 19 engaged to an external thread 20 on the barrel 15. It forms a continuation of passage 16, but has a taper 21 which reduces as it extends toward impact end 17. Impact end 17 is formed as a circular surface at the end of the adapter.

An inlet port 22 is formed through the wall of the impact barrel. An end cap 25 has a port 26 aligned with port 22. An inlet fitting 27 is welded to the end cap, and the end cap is welded to the impact barrel. This forms an impact barrel open at its impact end 17 and closed at its striker end 30, with the inlet port adapted to be connected to a source of agent under pressure. If desired, a shut off valve and/or a quick hose disconnect can be incorporated in the fitting, or can be provided upstream of the inlet port as desired.

A group of sawtooth-tapered retention bevels 30 are circumferentially formed around the outside of the impact barrel. Each of these has a retention shoulder 31. After the impact barrel is forced through a barrier these shoulders act as means to keep the impact barrel from being expelled from the barrier.

A rod passage 35 is formed in the end cap on the axis. A socket member 36 is trapped between the impact barrel and the end cap by its shoulder 37. It includes a tapered socket 38 which enlarges as it extends away from the impact end.

A nozzle barrel 40 is generally tubular and makes a slip fit in the impact barrel over the major portion of its stroke inside the impact barrel. It has a central passage 41 terminating at an internal thread 42. Point 12 has an exterior thread 43 which engages in thread 42, and which closes the impact end of the nozzle barrel. Point 12 has an external shoulder 44 which faces impact end 17 of the impact barrel and is laterally aligned with it so that axial forces exerted on the impact barrel are transmitted to the point through shoulder 44.

The exterior wall 45 of the nozzle barrel is cylindrical over most of its length, but has a tapered region 46 with a taper which matches and laterally overlaps taper 21 in the impact barrel. The angularity and dimensions of these tapers are sufficient to prevent the nozzle barrel from being expelled from the impact barrel when fluid pressure is exerted in the barrels, and to provide a close fit to prevent excessive agent blow-by. Of course shoulders or other restraint means could be provided instead of or in addition for this purpose.

A ring-groove 48 in the nozzle barrel receives an O-ring 49 to seal between the nozzle barrel and the impact barrel to prevent flow-by of the agent Nozzle ports 50, directed in various lateral directions through the wall of the nozzle barrel provide for distribution of the agent to be injected into this structure.

A tapered socket 55 is formed at the impact end, narrowing as it extends toward the impact end. It is located centrally on the central axis.

A slide rod 60 is slidably fitted in port 35 in the end cap. A sleeve 61 can be provided to make a close fit with the rod, and may if desired also provide a smooth surface along which the rod will slide. A retainer 62 is attached to end 63 of the rod, inside the barrels. A first taper 64 faces toward tapered socket 38. A second taper 65 faces toward the tapered socket 55. The angles of the tapers are locking angles, such that when a taper is forced into its respective socket, it will remain there until a sufficient axial force is exerted to remove it.

Thus, when taper 65 is held in socket 55, the slide rod will be held mostly inside the barrels. Then it projects the least beyond them. The firefighter can carry the tool in its smallest envelope configuration.

When the tool is to be used, the slide rod is pulled away from socket 55, and taper 64 is forced into socket 38. The slide rod is then held extended for a purpose to be described, and also is removed from the fluid flow path from the inlet port.

A collar 70 is fitted to end 71 of the slide rod. This traps slide hammer 13 between it and the striker end 30 of the impact barrel. The hammer has a striker face 77 adapted to strike against striker surface 78 on the end cap. The hammer has a rod passage 79 to receive the rod. A lock 80 comprises a laterally movable body 81 with a rod passage 82 through it. A bias means 83 is fitted in a bore 84 which receives post 85 in which passage 82 is formed. It may conveniently be a resiliently deformable O-ring seated in the bore, which biases surface 86 against the rod to prevent the slide hammer from sliding along the rod. When the lock is pressed toward the rod, it overcomes the bias force and moves surface 86 from the rod so the slide hammer can be reciprocated along the rod while the lock is pressed by being gripped by the user's hand.

When the tool is stored or carried, the slide rod is locked inwardly by engagement of taper 65 in socket 55. The tool is stable.

When it is to be used, the hammer is gripped and impacted against collar 70. This will pull taper 65 out of socket 55, and the rod can be pulled out so that taper 64 is forced into socket 38. The tool is now stable in this arrangement. The rod will remain extended until and unless this engagement is released. While the other taper and socket are engaged, the engagement holds much of the slider rod in the barrels, and holds the nozzle barrel retracted into the impact barrel. The cap on the slider rod limits the extension of the nozzle barrel until this latter engagement is released. The tapers 64 and 65 and sockets 38 and 55 are sometimes referred to as "retention means".

The lock is pressed an the slide hammer is brought time and again against striker surface 78. These sharp blows will be transmitted to the point, which will penetrate the barrier. All this time, no fluid pressure has been applied in the barrel.

After the point has penetrated the barrier, fluid under pressure will be admitted to the barrels. The pressure of the agent fluid will overcome any resistance to extention of the nozzle barrel. This will extend the nozzle barrel and expose the ports. The engagement of the tapers 21 and 46 on the barrels will prevent the nozzle barrel from separating from the impact barrel. Fluid pressure in the impact barrel adds force to sustain the extension of the nozzle barrel. The nozzle ports will deliver a distributed stream of fire extinguishing or suppressant agents to the inside of the barrier. The engaged tapers will hold the nozzle barrel extended without further attention even when the fluid pressure is released.

It will be apparent that this tool is compact for carriage, and in use allows the firefighter to do his work in a stable position. It is substantially maintenance-free, and is not subject to appreciable wear or deterioration. Cleaning and occasional replacement of the point are about as much maintenance as need be anticipated.

The term "barrier" is used in its broadest sense as an impediment to access to an enclosed region in which a fire exists. It could be the skin of an aircraft fuselage, the ceiling of a room beneath an attic, a wall, or a partition, or any number of other obstacles which firefighters much penetrate.

This invention is not to be limited by the embodiment shown in the drawings and described in the description, which is given by way of example and not of limitation, but only in accordance with the scope of the appended claims.

I claim:

1. A penetrator for percussively penetrating a structure for extinguishing a fire in said structure, said penetrator having an impact end and a striker end, comprising:

an impact barrel having a central axis, an axially-extending internal guide wall, a striker end and an impact end;

an axially extending nozzle barrel slidably disposed in said impact barrel, and having an axially-extending passage, said nozzle barrel having a peripheral wall with nozzle ports therethrough;

a point attached to said nozzle barrel, projecting beyond said impact barrel;

a shoulder on said point laterally aligned with said impact end of said impact barrel for transmission of impact forces from said impact barrel to said point;

an end cap on said impact barrel at its striker end closing said impact barrel, and having an axially extending rod passage therethrough;

a slide rod slidably fitted in said end cap, and a collar on said rod outside of said impact barrel;

a slide hammer reciprocably slidably fitted on said slide rod having a striker face disposed and arranged so as to be impacted on the striker end of the impact barrel;

retention means on said barrels preventing the nozzle barrel from being expelled from the impact barrel;

rod retention means adapted to retain said slide rod in a first axial position closer to said impact end, and a second axial position closer to said striker end, in said first position much of the striker rod is housed in said barrels to reduce the total axial length of the penetrator, and in said second position much of the slide rod is outside of the barrels to provide a guidance of substantial length for said slide hammer; and inlet port means through said impact barrel for admitting fluid under pressure into the barrels;

whereby impact of the slide hammer on the impact barrel exerts forces on the structure through the point to penetrate the structure, and whereby after penetration of the structure by the point, fluid under pressure will be admitted to the barrels, thereby extending the nozzle barrel, and exposing the nozzle ports inside the structure in order to inject fluid agent into the structure.

2. A penetrator according to claim 1 in which said rod retention means comprises a plug and socket engageable to hold the rod in its first position.

3. A penetrator according to claim 1 in which said retention means on said barrels comprise a pair of complementary tapers.

4. A penetrator according to claim 1 in which said hammer includes a lock to hold it fixed to said slide rod, said lock being released by a squeeze on the hammer when held to be impacted.

5. A penetrator according to claim 2 in which said retention means on said barrels comprise a pair of complementary tapers.

6. A penetrator according to claim 2 in which said hammer includes a lock to hold it fixed to said slide rod, said lock being released by a squeeze on the hammer when held to be impacted.

7. A penetrator according to claim 4 in which said retention means on said barrels comprise a pair of complementary tapers.

* * * * *